US008303740B1

(12) United States Patent
McClurg

(10) Patent No.: US 8,303,740 B1
(45) Date of Patent: Nov. 6, 2012

(54) SELF-IGNITING PYROTECHNICAL SPARKLER

(76) Inventor: Warren T. McClurg, Canfield, OH (US)

( * ) Notice: Subject to any disclaimer, the term of this patent is extended or adjusted under 35 U.S.C. 154(b) by 0 days.

(21) Appl. No.: 13/085,084

(22) Filed: Apr. 12, 2011

Related U.S. Application Data

(60) Provisional application No. 61/323,056, filed on Apr. 12, 2010.

(51) Int. Cl.

| | |
|---|---|
| ***C06B 45/00*** | (2006.01) |
| ***C06B 33/06*** | (2006.01) |
| ***C06B 29/02*** | (2006.01) |
| ***F42B 4/00*** | (2006.01) |

(52) U.S. Cl. ..... 149/3; 149/42; 149/77; 102/335

(58) Field of Classification Search ..... 149/3, 42, 149/77; 102/335
See application file for complete search history.

(56) References Cited

U.S. PATENT DOCUMENTS

2002/0117071 A1* 8/2002 Kaliszewski ..... 102/335
* cited by examiner

*Primary Examiner* — Aileen B Felton
(74) *Attorney, Agent, or Firm* — Cohen & Grigsby, P.C.

(57) ABSTRACT

A self igniting pyrotechnical sparkler. The sparkler includes a nonflammable support member or rod substantially covered with a pyrotechnic coating composition along one end and a pyrotechnical igniter coating covering over part of the pyrotechnic coating. The igniter coating including a mixture of potassium chlorate, antimony sulfate, powder aluminum, particulate magnesium, binder and/or glass beads.

7 Claims, 2 Drawing Sheets

SELF-IGNITING PYROTECHNICAL SPARKLER

CLAIM OF PRIORITY

This invention claims the benefit of U.S. Provisional Application No. 61/323,056, filed on Apr. 12, 2010.

BACKGROUND OF THE INVENTION

Sparklers are non-explosive, pyrotechnic devices which have been enjoyed for many years. They are basically comprised of a wire rod with a pyrotechnic coating composition which extends substantially the length of the rod. The uncoated portion of the rod serves as a handle. The composition is ignited by the use of a match or similar fire producing device which serves to initiate the pyrotechnic display of sparks emanating from the composition on the sparkler's rod.

It is well known that it is difficult to initiate sparklers because of the time it takes for the match or external flame to heat and ignite the pyrotechnic material. This can be dangerous to those igniting them, especially younger persons. Accordingly, it is an object of the present invention to provide a sparkler which can be ignited quickly, easily, and safely without the necessity of an external source of a flame. Furthermore, the invention provides a sparkler having an end with an additional pyrotechnic composition that permits the user to ignite it by striking the end on a safety striking surface such as that found on the packages of safety matches. The striking composition at the end of sparkler operates to initiate the sparkler pyrotechnic on the first or second striking. This striking is done safely away from the sparkling pyrotechnic which could otherwise burn the fingers of a user attempting to hold a lighted match under prior art sparklers. Other advantages of the present invention will become apparent from the detailed description of the present invention.

SUMMARY OF THE INVENTION

Various embodiments of the present invention are directed to a self igniting pyrotechnical sparkler for use with a safety strike surface having a rod which includes a pyrotechnic coating composition capable of producing sparks on ignition which covers a substantial length of the rod and the uncoated portion of the rod comprising a handle to hold such rod. A pyrotechnical igniter coating is positioned over the coating composition at the end opposite from the handle for striking a safety strike surface. The pyrotechnical igniter coating is preferably positioned directly over part of the pyrotechnic coating on the rod at the end opposite the handle.

Various embodiments of the invention are directed to a mixture of particulate potassium chloride, antimony sulfate, powder aluminum, particulate magnesium, cellulose nitrate and glass beads. These particulates are preferably in sizes between about 7 to 00 μm. The cellulose nitrate preferably includes 25 wt % of nitrocellulose lacquer.

Those and other details, objects and advantages of the present invention will become better understood or apparent from the following description and drawing showing an embodiment thereof.

BRIEF DESCRIPTION OF THE DRAWINGS

Embodiments of the present invention are described herein by way of example in conjunction with the following figures.

DESCRIPTION

Figure 1:
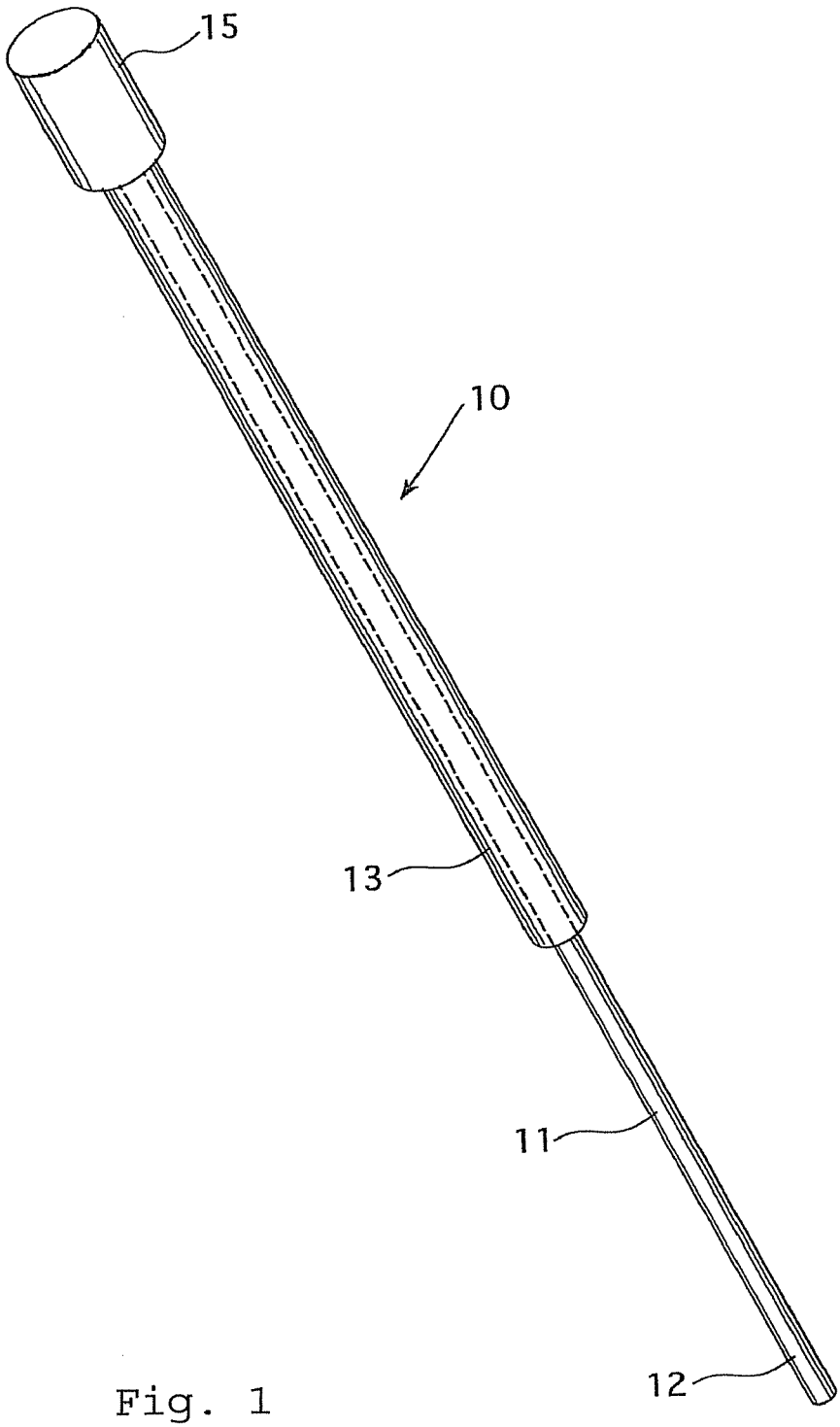
FIG. 1 is a perspective view of a sparkler according to various embodiments of the invention.
Figure 2:
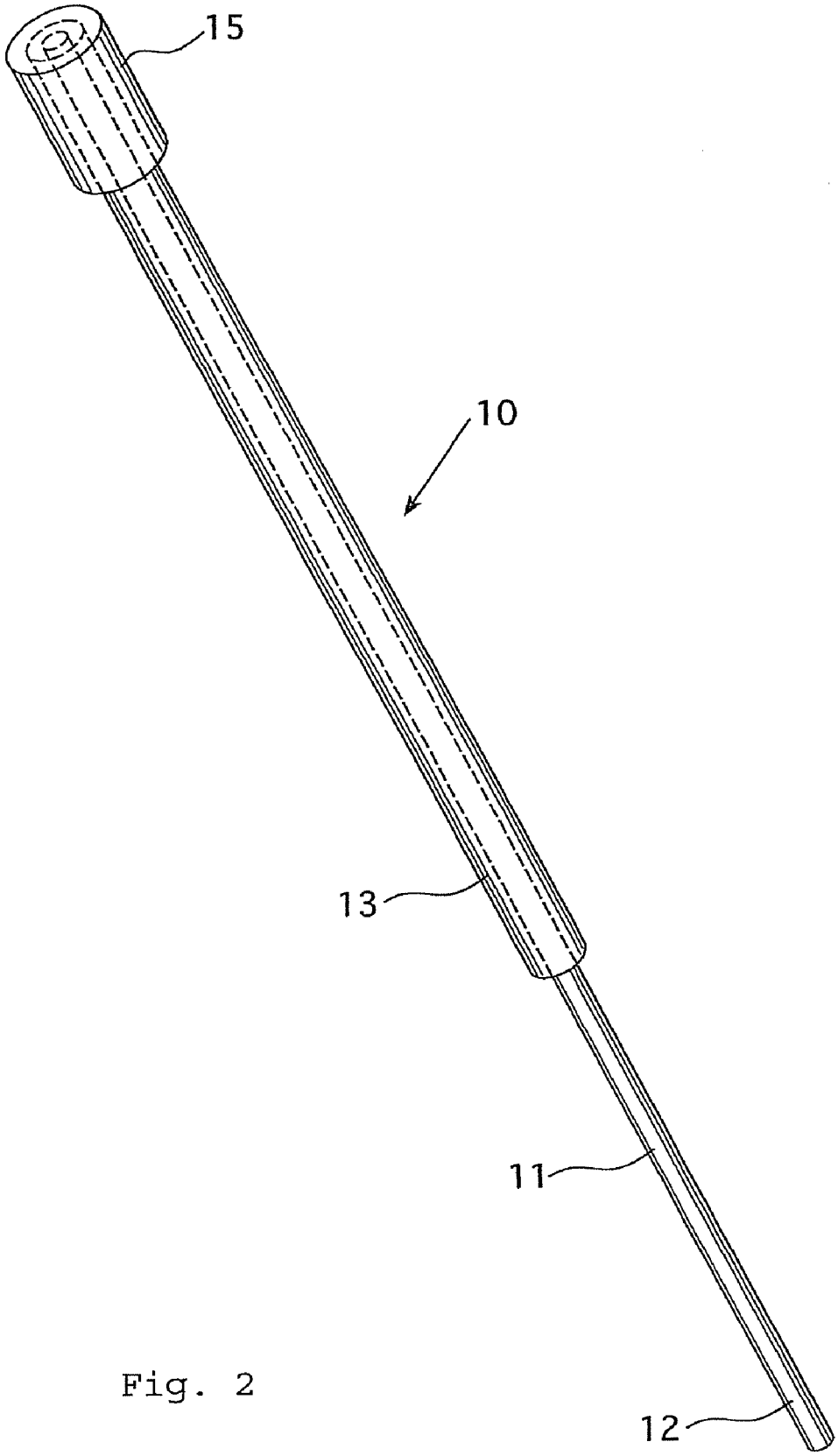
FIG. 2 is a perspective view of a sparkler with an end cut way view according to various embodiments of the invention.

Embodiments of the present invention are directed to a self-ignitable sparkler. FIG. 1 depicts a self-igniting sparkler 10 according to various embodiments of the present invention. Sparkler 10 comprises a support member or rod 11, such as a metal wire or other nonflammable material. Support member 11 provides a handle 12 at one end and a first pyrotechnic composition coating 13 extending the remaining length of member 11. First pyrotechnic coating 13 is a conventional mixture of pyrotechnic materials. Coating 13 is preferably placed on member 11 by means of a multi-step slurry dipping process known in the prior art. The chemistries of the prior art processes can provide various additives to enhance the sparkling action or color renditions of the sparks and do not constitute a part of the invention.

At the end of rod 11 opposite from handle 12, is initiator coating 15. Igniter coating 15 is preferably a composition selected from those described hereinafter which is coated over composition coating 13 by a dipping process in, for example, an additional dipping station. Initiator coating 15 is bonded to the pyrotechnic composition coating 13. The composition of igniter coating 15 is ignited upon striking igniter coating 15 on the ignition pad of a safety match box or envelope. In preferred embodiments of the invention, the results of testing indicate that the functionality of the composition mixture is highly dependent upon the particle size of the components as well as the amount of binder that is present in the solution. The formulations shown below in the presently preferred embodiments resulted in observed ignitions 95% of the time.

The details of preferred compositions are listed in the Tables below. The results and any observations made during each evaluation immediately follow a number of the tables. Particle analysis was not performed on the antimony sulfate due to the limited amount and high cost of this material. The antimony sulfate powder appeared to be very fine and mixed well with the potassium chlorate. Results from the tests indicate that the functionality of the mixture is highly dependent upon the particle size of the components as well as the amount of binder that is present in the solution. The formulation shown for example in Table 6 below resulted in 36 observed ignitions out of the 38 samples tested. Examples of preferred embodiments of the present invention are set forth below.

Various formulations were prepared by using the following general procedure. Potassium chlorate was first crushed into a fine powder. This was done to break up larger chunks that had formed in the powder due to the hygroscopic properties of potassium chlorate. The potassium chlorate was then weighed and transferred into a container. Next, antimony sulfate was weighed and transferred into the container of the potassium chlorate. The contents of that container were then slowly stirred into a uniform mixture.

The selected amounts of aluminum powder and magnesium were then weighed and transferred to an empty container. This mixture was then slowly stirred into a uniform mixture. The contents from the container containing the oxidizers were then slowly transferred to the container containing the metals and the mixture was stirred.

Thereafter, the desired amount of nitrocellulose was weighed and transferred to the mixture. The mass of this combined mixture was recorded. Next, acetone was added to the solution for viscosity of the mixture for dipping purposes and to see if it stayed on or stuck to the pyrotechnic coating 13. The resulting mixture was stirred until it appeared to be uniform. Crushed glass was then added and the mixture was stirred until the solution became "soup-like" in appearance.

The tip ends of commercially available sparklers were then dipped into the resulting soup-like solution twice, allowing approximately 2 minutes of drying time between each application. Once all of the samples were dipped, they were allowed to air dry for approximately 1 hour in a fume hood. The samples were then transferred to a vacuum oven and allowed to dry for 12 hours at 60° C. Once dried, the samples were evaluated by striking the ends of the sparklers on a match book striking surface. Observations of ignition, sparks, or no-ignition were made and recorded. Up to 5 strikes were attempted on each sparkler. If the sparkler ignited, the number of strikes attempted before ignition was recorded.

Compositions Tested

A number of compositions prepared in accordance with the invention were tested. The results and any observations made during test evaluations of the present invention are set forth below.

| Component | Particle Size (μm) | Volume (mL) | Mass (g) | Weight Percent |
|---|---|---|---|---|
| Potassium Chlorate | 32 | — | 4.22 | 40.15% |
| Antimony (III) Sulfate | — | — | 1.05 | 9.99% |
| Aluminum Powder | 37 | — | 1.05 | 9.99% |
| Magnesium | 201 | — | 0.23 | 2.19% |
| Collodion (4%-8%) | — | ~13.5* | 0.81 | 7.71% |
| Ground Glass (250 micron) | 79 | — | 2.1 | 19.98% |
| Ground Glass (500 micron) | 96 | — | 1.05 | 9.99% |

| Component | Particle Size (μm) | Volume (mL) | Mass (g) | Weight Percent |
|---|---|---|---|---|
| Potassium Chlorate | 32 | — | 4.2172 | 40.74% |
| Antimony (III) Sulfate | — | — | 1.0500 | 10.14% |
| Aluminum Powder | 8 | — | 1.0486 | 10.13% |
| Magnesium | 61 | — | 0.2084 | 2.01% |
| Nitrocellulose Lacquer (25%) | — | ~2.7* | 0.6700 | 6.47% |
| Glass (−60 mesh) | 216 | — | 2.1114 | 20.40% |
| Glass (−100 mesh) | 78 | — | 1.0459 | 10.10% |
| Acetone | — | 7 | — | — |

In this example, 2 out of the 5 sparklers ignited.

The remaining 3 that did not ignite sparked during the striking procedure. In addition to the sparklers, five wooden sticks were dipped and tested and all five ignited. During the striking attempts, the samples that did not ignite produced burning particles that flew off of the sample. This prevents flame propagation to occur on the sparkler and creates a potential burn hazard. The particle size of the aluminum was increased for this composition in attempt to slow down the burn rate of samples and prevent particles from igniting so rapidly that they become detached from the sparkler

| Component | Particle Size (μm) | Volume (mL) | Mass (g) | Weight Percent |
|---|---|---|---|---|
| Potassium Chlorate | 32 | — | 4.2255 | 39.33% |
| Antimony (III) Sulfate | — | — | 1.0510 | 9.78% |
| Aluminum Powder | 7 | — | 1.0547 | 9.82% |
| Magnesium | 61 | — | 0.2153 | 2.00% |

-continued

| Component | Particle Size (μm) | Volume (mL) | Mass (g) | Weight Percent |
|---|---|---|---|---|
| Nitrocellulose Lacquer (25%) | — | ~4.6* | 1.0305 | 9.59% |
| Glass (−60 mesh) | 216 | — | 2.1171 | 19.70% |
| Glass (−100 mesh) | 78 | — | 1.0506 | 9.78% |
| Acetone | — | 5 | — | — |

The nitrocellulose binder component was increased in this mixture to better hold the composition together during the striking procedure. In this example, 3 out of the 6 sparklers ignited after 2 or 3 strikes.

| Component | Particle Size (μm) | Volume (mL) | Mass (g) | Weight Percent |
|---|---|---|---|---|
| Potassium Chlorate | 32 | — | 4.2209 | 37.53% |
| Antimony (III) Sulfate | — | — | 1.0464 | 9.30% |
| Aluminum Powder | 7 | — | 1.0564 | 9.39% |
| Magnesium | 61 | — | 0.2078 | 1.85% |
| Nitrocellulose Lacquer (25%) | — | ~6.5* | 1.5499 | 13.78% |
| Glass (−60 mesh) | 216 | — | 2.1137 | 18.80% |
| Glass (−100 mesh) | 78 | — | 1.0508 | 9.34% |
| Acetone | — | 5 | — | — |

The nitrocellulose binder component was doubled for this composition. 12 out of 12 sparklers ignited after 1 to 2 strikes.

| Component | Particle Size (μm) | Volume (mL) | Mass (g) | Weight Percent |
|---|---|---|---|---|
| Potassium Chlorate | 32 | — | 4.2232 | 37.59% |
| Antimony (III) Sulfate | — | — | 1.0531 | 9.37% |
| Aluminum Powder | 7 | — | 1.0546 | 9.39% |
| Magnesium | 61 | — | 0.2106 | 1.87% |
| Nitrocellulose Lacquer (25%) | — | ~6.5* | 1.5306 | 13.62% |
| Glass (−60 mesh) | 216 | — | 2.1144 | 18.82% |
| Glass (−100 mesh) | 78 | — | 1.0486 | 9.33% |

The composition in Example 4 was replicated. The dipping procedure began using a slightly more dilute solution and a thinner application was noted on some of the samples. In this example, 24 out of 26 sparklers ignited.

Presently Preferred Embodiment

| Component | Particle Size | Weight Percent |
|---|---|---|
| Potassium Chlorate | 32 μm | 37.3% |
| Antimony Trisulfide | — | 9.3% |
| Aluminum Powder (3 μm) | 7 μm | 9.3% |
| Magnesium (74 μm-44 μm) | 61 μm | 1.8% |
| Cellulose Nitrate (25 wt. % Nitrocellulose Lacquer) | — | 14.4% |
| Glass (−60 Mesh) | 216 μm | 18.7% |
| Glass (−100 Mesh) | 78 μm | 9.2% |

Three additional compositions were formulated using the same procedure set forth above in Example 6. The details of each composition are listed below. Please note that particle analysis was not performed on the antimony sulfate due to the limited amount and high cost of this material. However, this powder appeared to be very fine and mixed well with the potassium chlorate.

| Component | Particle Size (μm) | Volume (mL) | Mass (g) | Weight Percent |
|---|---|---|---|---|
| Potassium Chlorate | 32 | — | 4.2285 | 33.94% |
| Antimony (III) Sulfate | — | — | 1.0523 | 8.45% |
| Aluminum Powder | 7 | — | 1.0498 | 8.43% |
| Magnesium | 61 | — | 0.2111 | 1.69% |
| Nitrocellulose Lacquer (25%) | — | ~3.3* | 2.7539 | 22.10% |
| Glass (−60 mesh) | 216 | — | 2.1149 | 16.97% |
| Glass (−100 mesh) | 78 | — | 1.0491 | 8.42% |
| Acetone | — | 5 | — | — |

| Component | Particle Size (μm) | Volume (mL) | Mass (g) | Weight Percent |
|---|---|---|---|---|
| Potassium Chlorate | 32 | — | 4.2271 | 36.97% |
| Antimony (III) Sulfate | — | — | 1.0492 | 9.18% |
| Aluminum Powder | 7 | — | 1.0501 | 9.18% |
| Magnesium | 61 | — | 0.211 | 1.85% |
| Nitrocellulose Lacquer (25%) | | ~2.8* | 1.7403 | 15.22% |
| Glass (−60 mesh) | 216 | — | 2.1109 | 18.46% |
| Glass (−100 mesh) | 78 | — | 1.0449 | 9.14% |
| Acetone | 5 | — | — | — |

| Component | Particle Size (μm) | Volume (mL) | Mass (g) | Weight Percent |
|---|---|---|---|---|
| Potassium Chlorate | 32 | — | 4.216 | 37.26% |
| Antimony Trisulfide | — | — | 1.0492 | 9.27% |
| Aluminum Powder | 7 | — | 1.0483 | 9.27% |
| Magnesium | 61 | — | 0.2091 | 1.85% |
| Nitrocellulose Lacquer (25%) | — | ~2.8* | 1.63013 | 14.41% |
| Glass (−60 mesh) | 216 | — | 2.1144 | 18.69% |
| Glass (−100 mesh) | 78 | — | 1.0471 | 9.25% |
| Acetone | — | 5 | — | — |

In Example 9, Antimony trisulfide was substituted for antimony (III) sulfate and 20 out of 20 sparklers ignited after 1 to 2 strikes. It should be noted that these tests were conducted using a very worn striking surface. When a fresh standard matchbook surface was used, 10 out of 10 ignited on the first strike. Application of this composition to the sparklers resulted in a sparkler that was very easy to ignite and produced an initial burn that was very similar to that of a sparkler that was not dipped in the composition.

Observations made during the evaluations of these compositions show that the binder (nitrocellulose) needs to account for approximately 14.4 wt % of the solution. Compositions with lower binder levels are not preferred nor are binder levels higher than 22.1 wt %. Sparklers were ignited when the binder accounted for 22.1 wt %; however, several attempts (3 strikes or greater) were necessary for ignition to occur.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention.

The invention claimed is:

1. A self igniting pyrotechnical sparkler for use with a safety strike surface comprising i) a rod having a pyrotechnic coating capable upon ignition of producing sparks, said pyrotechnic coating covering a substantial length of said rod leaving an uncoated portion, the uncoated portion of said rod comprising a handle for holding such rod; and ii) a pyrotechnical igniter coating positioned on at least a portion of the pyrotechnic coating at an end of the rod opposite said handle for striking a safety strike surface to ignite said sparkler, said pyrotechnic coating comprising a mixture of from 32 to 44% potassium chlorate, 8.4 to 9.9% antimony trisulfide, 8.4 to 9.3% aluminum powder, 1.7 to 18% magnesium, 14.4 to 22% cellulose nitrate and glass (60) 17 to 19% and glass (100) 8 to 9.2% by weight.

2. The self igniting pyrotechnic sparkler as set forth in claim 1, wherein said magnesium is particulate magnesium and the particles have a size of from about 7 to 300 μm.

3. The self igniting pyrotechnic sparkler as set forth in claim 1, wherein said potassium chlorate is present in amount of from about 35 to 40 percent by weight and said glass beads comprise 25 to 30 percent by weight.

4. The self igniting pyrotechnic sparkler as set forth in claim 1 wherein glass beads comprise 17 to 20 percent −60 mesh and 8 to 11 percent −100 mesh by weight.

5. The self igniting pyrotechnic sparkler as set forth in claim 1 wherein the binder comprises cellulose nitrate in an amount of about 14.4 wt % to 22.1 wt % of the mixture.

6. The self igniting pyrotechnic sparkler as set forth in claim 3 wherein glass beads comprise 17 to 20 percent −60 mesh and 8 to 11 percent −100 mesh by weight.

7. The self igniting pyrotechnic sparkler as set forth in claim 1 wherein the potassium chlorate has a particle size of 10 μm to 60 μm.

* * * * *